US008672314B2

(12) United States Patent
Sato et al.

(10) Patent No.: US 8,672,314 B2
(45) Date of Patent: Mar. 18, 2014

(54) SHEET STACKING APPARATUS

(75) Inventors: Mitsuhiko Sato, Kashiwa (JP); Toshiyuki Miyake, Abiko (JP); Shunsuke Nishimura, Tokyo (JP); Takashi Yokoya, Kashiwa (JP); Yutaka Ando, Toride (JP); Hiromasa Maenishi, Matsudo (JP); Akihiro Arai, Toride (JP); Nozomi Kumakura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 13/565,520

(22) Filed: Aug. 2, 2012

(65) Prior Publication Data

US 2013/0032992 A1 Feb. 7, 2013

(30) Foreign Application Priority Data

Aug. 5, 2011 (JP) ..... 2011-171996

(51) Int. Cl.
*B65H 39/00* (2006.01)

(52) U.S. Cl.
USPC ..... 270/58.27; 270/58.17; 270/58.28

(58) Field of Classification Search
USPC ..... 270/58.12, 58.13, 58.16, 58.17, 58.27, 270/58.28
See application file for complete search history.

(56) References Cited

U.S. PATENT DOCUMENTS

| | | | | |
|---|---|---|---|---|
| 6,832,759 | B2 * | 12/2004 | Nagasako et al. | 271/222 |
| 6,871,851 | B2 * | 3/2005 | Tamura et al. | 271/221 |
| 6,889,974 | B2 * | 5/2005 | Tamura et al. | 271/220 |
| 7,014,183 | B2 * | 3/2006 | Tamura et al. | 270/58.09 |
| 7,182,333 | B2 * | 2/2007 | Tamura et al. | 271/176 |
| 7,300,052 | B2 * | 11/2007 | Tamura et al. | 271/221 |
| 7,380,786 | B2 * | 6/2008 | Tamura et al. | 271/207 |
| 7,441,771 | B2 * | 10/2008 | Tamura et al. | 271/207 |
| 7,451,980 | B2 * | 11/2008 | Tamura et al. | 271/220 |
| 7,681,881 | B2 * | 3/2010 | Kunieda et al. | 271/221 |
| 7,731,187 | B2 * | 6/2010 | Horio et al. | 271/217 |
| 7,766,324 | B2 * | 8/2010 | Tamura et al. | 271/213 |
| 8,070,150 | B2 * | 12/2011 | Tanaka et al. | 270/58.27 |
| 8,136,807 | B2 * | 3/2012 | Uchiyama et al. | 270/58.27 |
| 8,177,227 | B2 * | 5/2012 | Uchiyama et al. | 271/220 |
| 8,251,362 | B2 * | 8/2012 | Konishi | 270/58.17 |

* cited by examiner

*Primary Examiner* — Leslie A Nicholson, III
(74) *Attorney, Agent, or Firm* — Canon USA Inc IP Division

(57) ABSTRACT

A sheet stacking apparatus includes an alignment member to align a sheet stacked on a stacking tray in a width direction perpendicular to a direction in which the sheet is discharged. When stacking a plurality of sheets on the stacking tray, the sheet stacking apparatus lowers the stacking tray, so that a predetermined distance is maintained between the top surface sheet and a sheet discharge port. If the stacking tray is lowered to a predetermined position while the alignment unit is executing an alignment operation at a first position, the sheet stacking apparatus lowers the alignment member to a second position lower than the first position and causes the alignment member to execute the alignment operation at the second position.

6 Claims, 19 Drawing Sheets

SHEET STACKING APPARATUS

BACKGROUND OF THE INVENTION

1. Field of the Invention

The present disclosure relates to a sheet stacking apparatus having a function of aligning discharged sheets.

2. Description of Related Art

Conventionally, a sheet post-processing apparatus (finisher) is discussed. After receiving a sheet from an image forming apparatus, the finisher discharges the sheet onto a discharge tray and causes alignment members arranged on the discharge tray to align the sheet in a direction perpendicular to the discharging direction. Since the alignment members arranged on the discharge tray align such discharged sheets, the sheets can be stacked neatly on the discharge tray. Such alignment processing is referred to as "neat stack."

An image forming apparatus uses heat to fix a toner image formed on a sheet onto the sheet. Thus, because of the heat added for fixing, a sheet transferred from the image forming apparatus to the finisher may be curled on a discharge tray.

FIGS. 14A and 14B illustrate states of sheets P stacked on a stacking tray 731. In FIG. 14A, the stack of sheets P on the discharge tray 731 is not curled. The discharge tray 731 is controlled to be positioned so that a sheet surface detection sensor 732 does not detect a sheet. Thus, the position of the top surface sheet of the stacked sheets P is maintained at approximately the height of the sheet surface detection sensor 732.

In contrast, in FIG. 14B, the stack of sheets P on the discharge tray 731 is curled. Based on a signal from the sheet surface detection sensor 732, the discharge tray 731 is lowered to a position where no sheet trailing edge blocks the discharge port. Thus, as illustrated in FIG. 14B, the position of the discharge tray 731 on which the curled sheets Pare stacked is lower than that of the discharge tray 731 on which the curled sheets P are not stacked. Therefore, depending on curling of the sheets P, even if an alignment member 730 moves in a width direction perpendicular to the sheet conveyance direction, the alignment member 730 does not come into contact with the side of the stacked sheets P. As a result, since the alignment member 730 executes a missed swing, an appropriate alignment operation may not be executed.

In response to this problem, U.S. Pat. No. 7,681,881 discusses arranging, other than the sheet surface detection sensor 732, a detection mechanism for detecting the position of the top surface of the stacked sheets at a position where the alignment member 730 comes into contact with the sheets in a sheet discharging direction. Based on the position of the sheet detected by the detection mechanism, the position of the alignment member 730 is adjusted vertically. Thus, if strongly curled sheets are stacked, the alignment member 703 is controlled to be lowered further, compared with when no curled sheets are stacked. Thus, when an alignment operation is executed, the alignment member 730 is prevented from executing a missed swing.

However, U.S. Pat. No. 7,681,881 requires a dedicated detection mechanism for detecting the position of the sheet surface at the position where the alignment member 730 comes into contact with the sheets, requiring a more complex configuration and increasing the cost.

SUMMARY OF THE INVENTION

The present disclosure is directed to a sheet stacking apparatus that is capable of preventing alignment members from executing a missed swing even when the alignment members align a curled sheet stack, without a cost increase.

According to an aspect disclosed herein, a sheet stacking apparatus includes a discharging unit configured to discharge a conveyed sheet, a stacking tray on which a sheet discharged by the discharging unit is stacked, an alignment unit configured to align a sheet stacked on the stacking tray in a width direction perpendicular to a direction in which the sheet is discharged, the alignment unit including an alignment member configured to be movable in the width direction, and a first moving unit configured to move the alignment member in the width direction, the alignment member aligning the sheet by coming into contact with a side of the sheet stacked on the stacking tray in the width direction, a detection unit configured to detect a position of a top surface of a plurality of sheets stacked on the stacking tray, a second moving unit configured to vertically move the stacking tray while a plurality of sheets are being stacked on the stacking tray, so that a predetermined distance is maintained between a position detected by the detection unit and a discharge port of the discharging unit, a third moving unit configured to vertically move the alignment member, and a control unit configured to cause, if the second moving unit lowers the stacking tray to a predetermined position while the alignment unit is executing an alignment operation at a first position, the third moving unit to lower the alignment member to a second position lower than the first position and cause the alignment member to execute the alignment operation at the second position.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the disclosure will be described in detail below with reference to the drawings.

Figure 1:
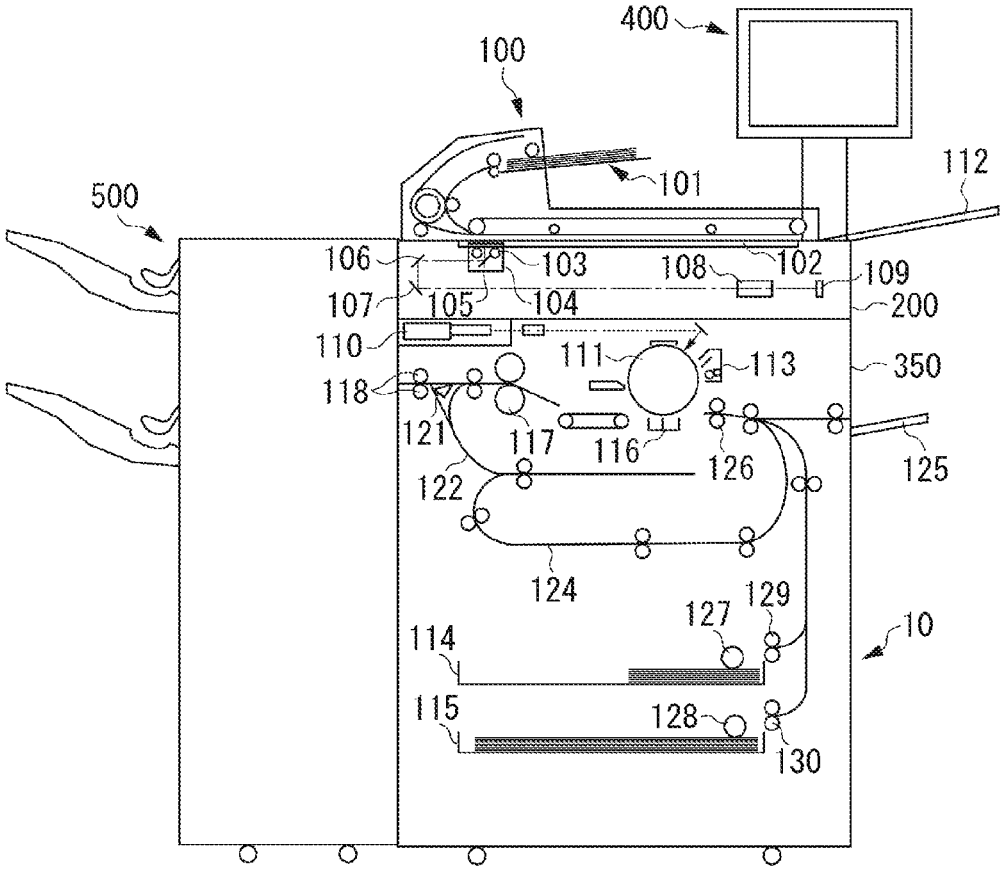
FIG. 1 is a cross section of an image forming system.

FIG. 1 is across section illustrating configurations of main sections of an image forming system according to an exemplary embodiment. The image forming system includes an image forming apparatus 10 and a finisher 500 used as a sheet stacking apparatus. The image forming apparatus 10 includes an image reader 200 reading an image from a document and a printer 350 forming the read image on a sheet.

A document feeding apparatus 100 sequentially feeds documents, which are set face-up on a document tray 101, one by one from the first page. After conveying a document to a predetermined reading position on a platen glass 102, the document feeding apparatus 100 discharges the document onto a discharge tray 112. In a read operation, a scanner unit 104 is fixed at a predetermined reading position. When a document travels through the reading position, the scanner unit 104 reads a document image. More specifically, when a document travels through the reading position, the document is illuminated with light emitted from a lamp 103 of the scanner unit 104. The reflected light from the document is guided to a lens 108 via mirrors 105 to 107. Next, by using the light transmitted through the lens 108, an image sensor 109 forms an image on an imaging plane, converts the image into image data, and outputs the image data as a video signal to an exposure unit 110 of the printer 350.

The exposure unit 110 of the printer 350 modulates and outputs a laser beam, based on the video signal supplied from the image reader 200. A polygonal mirror 110*a* scans and illuminates a photosensitive drum 111 with the laser beam. Based on the scanning laser beam, an electrostatic latent image is formed on the photosensitive drum 111. Next, a developing device 113 supplies developer, to make the electrostatic latent image on the photosensitive drum 111 visible as a developed image.

In the printer 350, pick-up rollers 127 and 128 feed a sheet from upper and lower cassettes 114 and 115 to registration rollers 126 via feeding rollers 129 and 130, respectively. When the leading edge of the sheet reaches the registration rollers 126, the registration rollers 126 are driven at a predetermined timing. Consequently, the registration rollers 126 feed the sheet to the path between the photosensitive drum 111 and a transfer unit 116. The transfer unit 116 transfers the developed image, which is formed on the photosensitive drum 111, onto the fed sheet. After the developed image is transferred onto the sheet, the sheet is conveyed to a fixing unit 117, which adds heat and pressure to the sheet to fix the developed image on the sheet. After travelling through the fixing unit 117, the sheet is discharged from the printer 350 to the outside of the image forming apparatus 10 (to the finisher 500) via a flapper (diverter) 121 and discharging rollers 118. If the image forming apparatus 10 executes two-sided printing on the sheet, the sheet is conveyed to a two-sided conveyance path 124 via a reversal path 122. As a result, the sheet is conveyed to the registration rollers 126, again.

Figure 2A:
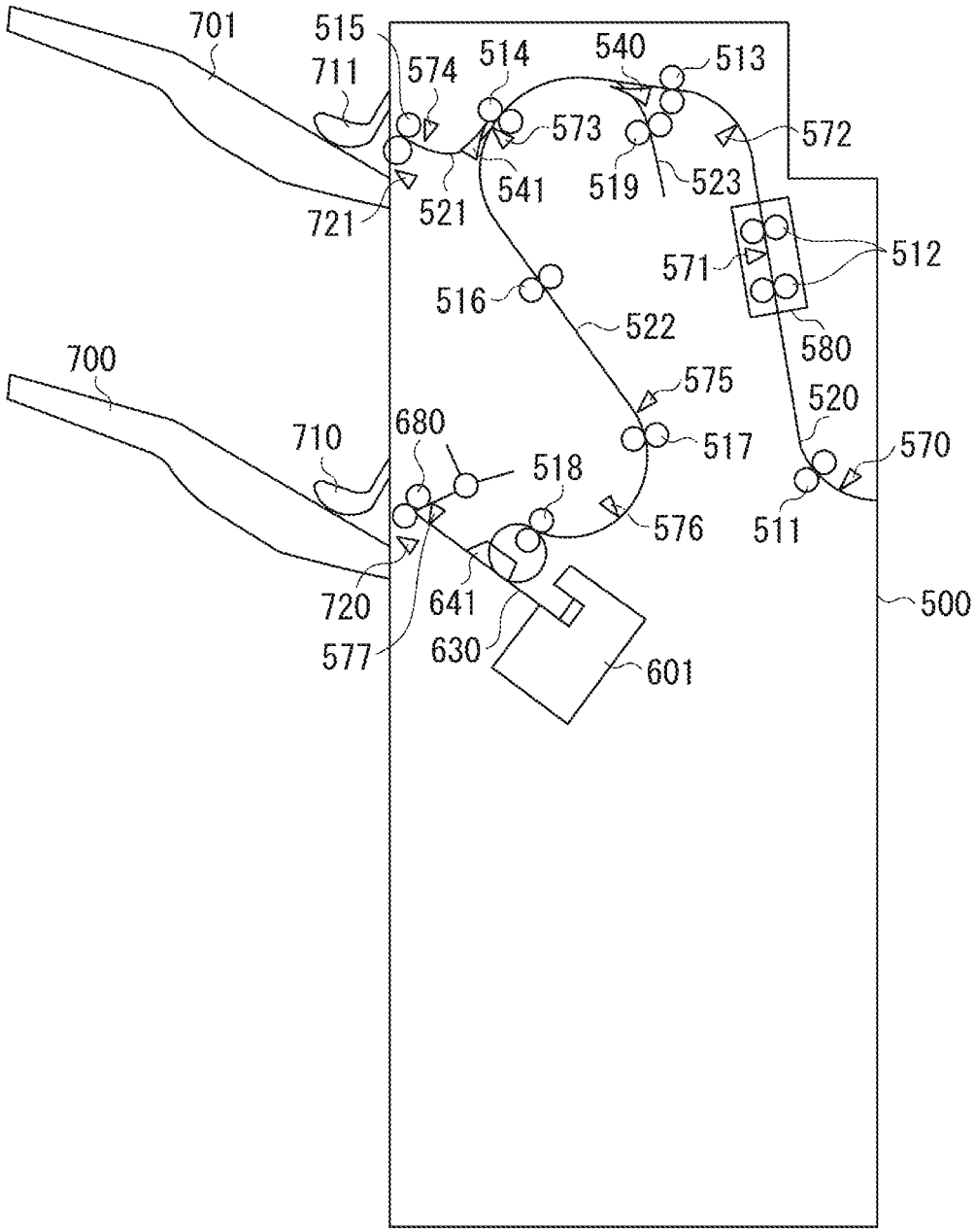
FIGS. 2A and 2B are cross sections of a finisher.
Figure 2B:
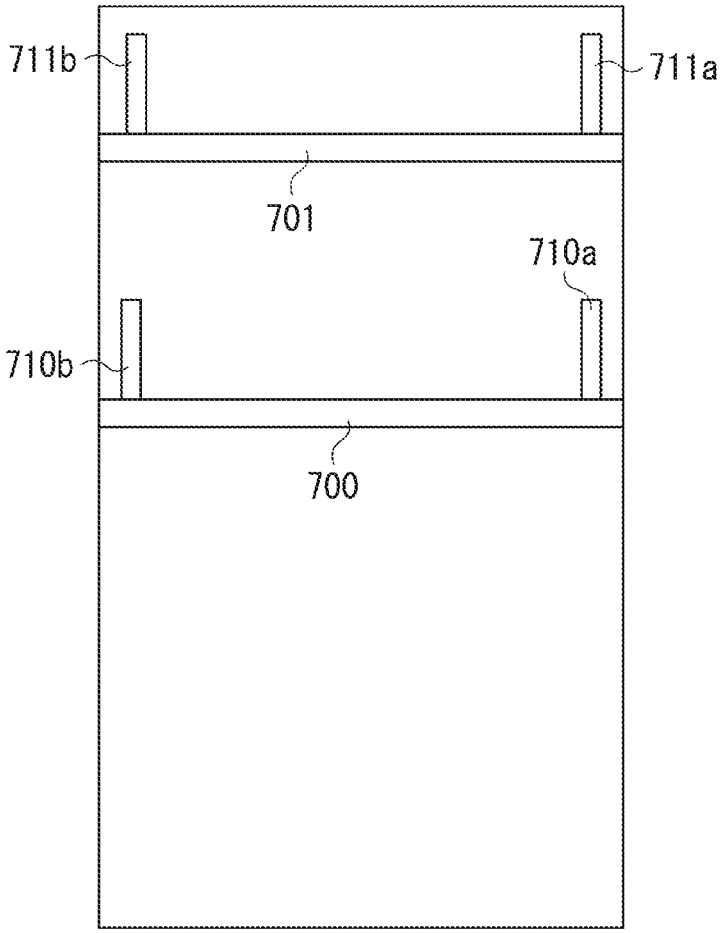

Next, a configuration of the finisher 500 will be described with reference to FIGS. 2A and 2B. FIGS. 2A and 2B illustrate a configuration of the finisher 500 in FIG. 1. FIG. 2A illustrates the finisher 500 as viewed from the front side, and FIG. 2B illustrates stacking trays 700 and 701 of the finisher 500 as viewed from the sheet discharging direction.

The finisher 500 sequentially receives the sheets discharged from the image forming apparatus 10 and executes sheet post-processing. For example, the finisher 500 aligns and stacks a plurality of supplied sheets together or staples a trailing end of a sheet stack. In the finisher 500, a conveyance roller pair 511 receives and conveys the sheets one by one discharged from the image forming apparatus 10 along the conveyance path 520. A sheet conveyed to the inside of the finisher 500 by the conveyance roller pair 511 is further conveyed by conveyance roller pairs 512 to 514. Conveyance sensors 570 to 573, each of which detects passage of the sheet, are arranged along the conveyance path 520. The conveyance roller pairs 512 and the conveyance path sensor 571 are included in a shift unit 580. Driven by a shift motor M11, the shift unit 580 can move the sheet in the sheet width direction, which is perpendicular to the conveyance direction. While the conveyance roller pairs 512 are pinching a sheet, if the shift motor M11 is driven, the sheet can be offset in the width direction while being conveyed. In a shift-sort mode, the sheet stack position is shifted in the width direction on a copy-by-copy basis. The sheet can be offset toward the front or rear side by 15 mm from the center position of the paper in the width direction (shift to the front side or shift to the rear side). If no shift amount is specified, the sheet is discharged to the front side (15 mm from the center position in the width direction). When the finisher 500 receives an input from the conveyance sensor 571 and detects that the sheet has traveled through the shift unit 580, the finisher 500 drives the shift motor M11 and returns the shift unit 580 to the center position.

A switching flapper 540 for guiding a sheet reversely conveyed by the conveyance roller pair 514 to a buffer path 523 is arranged between the conveyance roller pair 513 and the conveyance roller pair 514. The switching flapper 540 is driven by a solenoid (not illustrated), and a buffer path roller pair 519 is arranged along the buffer path 523. In addition, a switching flapper 541 for switching upper and lower discharge paths 521 and 522 is arranged between the conveyance roller pair 514 and an upper discharge roller pair 515. If the switching flapper 541 is controlled so that the sheet travels along the upper discharge path 521, the conveyance roller pair 514 driven by a conveyance motor M1 guides the sheet to the upper discharge path 521. Next, the upper discharge roller pair 515 driven by a discharge motor M2 discharges the sheet onto the upper discharge tray 701. An upper-tray discharge sensor 574 for detecting passage of the sheet is arranged along the upper discharge path 521. If the switching flapper 541 is controlled so that the sheet travels along the lower discharge path 522, the conveyance roller pair 514 driven by the conveyance motor M1 guides the sheet to the lower discharge path 522. Next, a first lower conveyance roller pair 516, a second lower conveyance roller pair 517, and a processing tray conveyance roller pair 518 driven by the conveyance motor M1 guide the sheet to a processing tray 630. First and second conveyance sensors 575 and 576 for detecting passage of the sheet are arranged along the lower discharge path 522.

A stack discharge roller pair 680 driven by a stack discharge motor (not illustrated) discharges the sheet onto the processing tray 630 or the lower discharge tray 700, depending on the post-processing mode. A lower tray discharge sensor 577 for detecting passage of the sheet is arranged on the processing tray 630. In addition, a stapler unit 601 is arranged on the processing tray 630. The stapler unit 601 staples a sheet stack aligned on the processing tray 630.

In addition, alignment plates 711*a* and 711*b* are arranged on the stacking tray 701, as illustrated in FIG. 2B. These alignment plates 711*a* and 711*b* are used as alignment members for aligning the sheets discharged on the stacking tray 701 in the sheet width direction. Hereinafter, the alignment plates 711*a* and 711*b* may collectively be referred to as the alignment plate 711, as needed. Likewise, alignment plates 710*a* and 710*b* are arranged on the stacking tray 700, as illustrated in FIG. 2B. These alignment plates 710*a* and 710*b* align the sheets discharged onto the stacking tray 700 in the sheet width direction. Hereinafter, the alignment plates 710*a* and 710*b* may collectively be referred to as the alignment plate 710, as needed. Lower-tray alignment motors (front-side) M6 and (rear-side) M7 can move the alignment plates 710*a* and 710*b* in the sheet width direction, respectively. The alignment plates 710*a* and 710*b* are arranged on the front and rear sides, respectively. Upper-tray alignment motors (front side) M3 and (rear side) M4 can move the alignment plates 711*a* and 711*b* in the sheet width direction, respectively. The alignment plates 711*a* and 711*b* are arranged on the front and rear side, respectively. In addition, an upper-tray alignment plate elevating motor M5 vertically drives the alignment plates 710*a* and 710*b*, and a lower-tray alignment plate elevating motor M8 vertically drives the alignment plates 711*a* and 711*b*.

In addition, upper- and lower-tray elevating motors M9 and M10 can vertically drive the stacking trays 700 and 701. Upper- and lower-tray sheet surface detection sensors 720 and 721 detect the trays 700 and 701 or the top surface of the sheets on the trays 700 and 701, respectively. Based on a detection result obtained by the sheet surface detection sensor 720/721, the finisher 500 drives and controls the tray elevating motor M9/M10 so that a certain distance is always maintained between the tray 700/701 and the corresponding discharge port or between the top surface of the sheets on the tray 700/701 and the corresponding discharge port. In addition, the sheet surface detection sensors 720 and 721 detect whether any sheet is present on the stacking trays 700 and 701.

Figure 3:
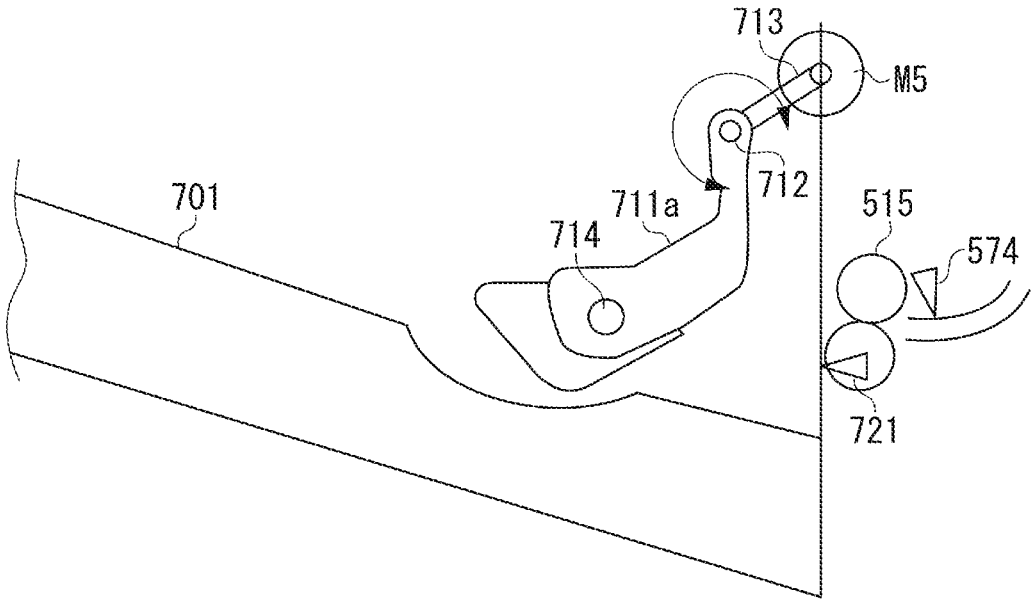
FIG. 3 illustrates an alignment member of the finisher.

Next, movement of the alignment plates will be described with reference to FIG. 3. The alignment plates 711*a* and 711*b* arranged on the stacking tray 701 move in the same way as the alignment plates 710*a* and 710*b* arranged on the stacking tray 700. Thus, only the alignment plates 711*a* and 711*b* arranged on the stacking tray 701 will hereinafter be described.

The alignment plate 711*a* is formed by two members coupled by a rotating shaft 714 and is connected to an elevating shaft 712. In addition, the elevating shaft 712 is connected to the upper-tray alignment plate elevating motor M5 via a driving belt 713, and the alignment plate 711*a* rotates around the elevating shaft 712 in the directions of the arrow illustrated in FIG. 3. The alignment plate 711*b* is formed in the same way as the alignment plate 711*a*. Namely, since connected to the elevating shaft 712, the alignment plate 711*b* rotates in synchronization with the alignment plate 711*a*. If the upper-tray alignment plate elevating motor M5 is driven, since the alignment plates 711*a* and 711*b* vertically move, the position relationship between the stacking tray 701 and the pair of the alignment plates 711*a* and 711*b* changes, as illustrated in FIG. 12. In addition, the alignment plates 711*a* and 711*b* are formed to extend toward the stacking tray 701 from a position above the discharge port near the upper discharge roller pair 515 used as a discharge means. In addition, the stacking tray 701 has a concave upper surface, so that the alignment plate 711 does not come into contact with the stacking tray 701 when moving in the width direction. In this way, even when only a single sheet is stacked on the stacking tray 701, the alignment plate 711 can come into contact with the sides of the sheet without fail.

Figure 4:
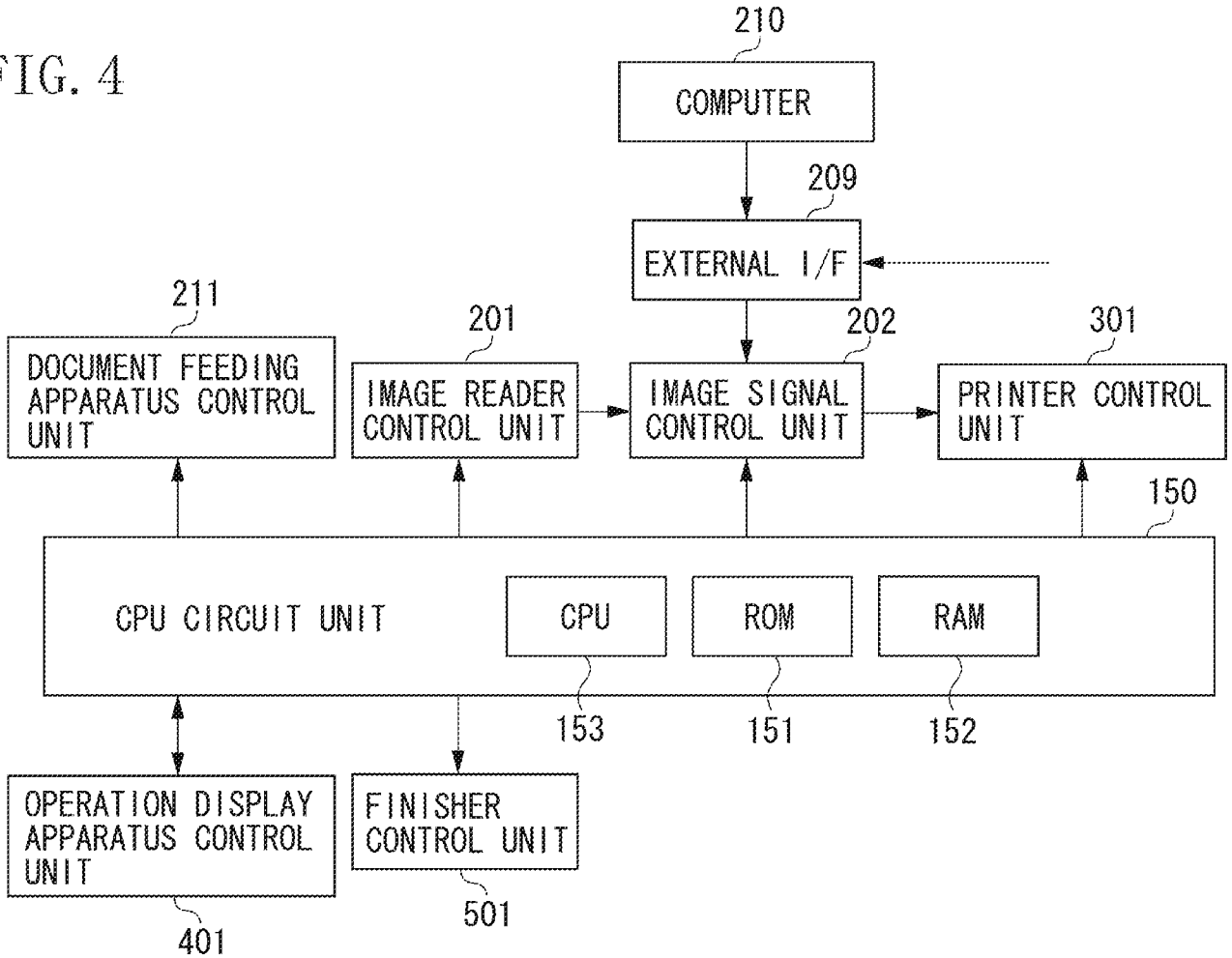
FIG. 4 is a block diagram illustrating an electrical configuration of the image forming system.

Next, a configuration of a controller comprehensively controlling the image forming system and a block diagram of the entire system will be described with reference to FIG. 4. FIG. 4 is a block diagram illustrating a configuration of a controller comprehensively controlling the image forming system in FIG. 1.

As illustrated in FIG. 4, the controller includes a central processing unit (CPU) circuit unit 150 including a CPU 153, a read-only memory (ROM) 151, and a random access memory (RAM) 152. The CPU 153 executes a basic control operation for the entire image forming system and is connected to the ROM 151 storing control programs and the RAM 152 executing processing via address and data buses. Based on the control programs stored in the ROM 151, the CPU 153 comprehensively controls an image reader control unit 201, an image signal control unit 202, a document feeding apparatus control unit 211, a printer control unit 301, an operation display apparatus control unit 401, and a finisher control unit 501. The RAM 152 temporarily stores control data and is used as a work area for calculation processing executed for a control operation.

The document feeding apparatus control unit 211 drives and controls the document feeding apparatus 100, based on instructions from the CPU circuit unit 150. The image reader control unit 201 drives and controls the above scanner unit 104, the image sensor 109, and the like and transfers an analog image signal supplied from the image sensor 109 to the image signal control unit 202. After converting the analog image signal supplied from the image sensor 109 into a digital signal, the image signal control unit 202 executes various processing on the digital signal, converts the processed digital signal into a video signal, and outputs the video signal to the printer control unit 301. In addition, the image signal control unit 202 executes various processing on a digital image signal supplied from a computer 210 via an external interface (I/F) 209, converts this processed digital image signal into a video signal, and outputs the video signal to the printer control unit 301. The CPU circuit unit 150 controls processing executed by the image signal control unit 202. Based on the supplied video signal, the printer control unit 301 controls the exposure unit 110 and the printer 350, to execute image formation and sheet conveyance. The finisher control unit 501 is included in the finisher 500. By exchanging information with the CPU circuit unit 150, the finisher control unit 501 comprehensively drives and controls the finisher 500. An operation of controlling the finisher 500 will be described in detail below. The operation display apparatus control unit 401 exchanges information between an operation display apparatus 400 and the CPU circuit unit 150. For example, the operation display apparatus 400 includes: a plurality of keys for setting various functions relating to image formation; and a display unit for displaying information indicating setting statuses. When detecting a key operation, the operation display apparatus control unit 401 outputs a corresponding key signal to the CPU circuit unit 150. When detecting a signal from the CPU circuit unit 150, the operation display apparatus control unit 401 causes the operation display apparatus 400 to display corresponding information. The finisher control unit 501 may be included in the image forming apparatus 10.

Figure 5:
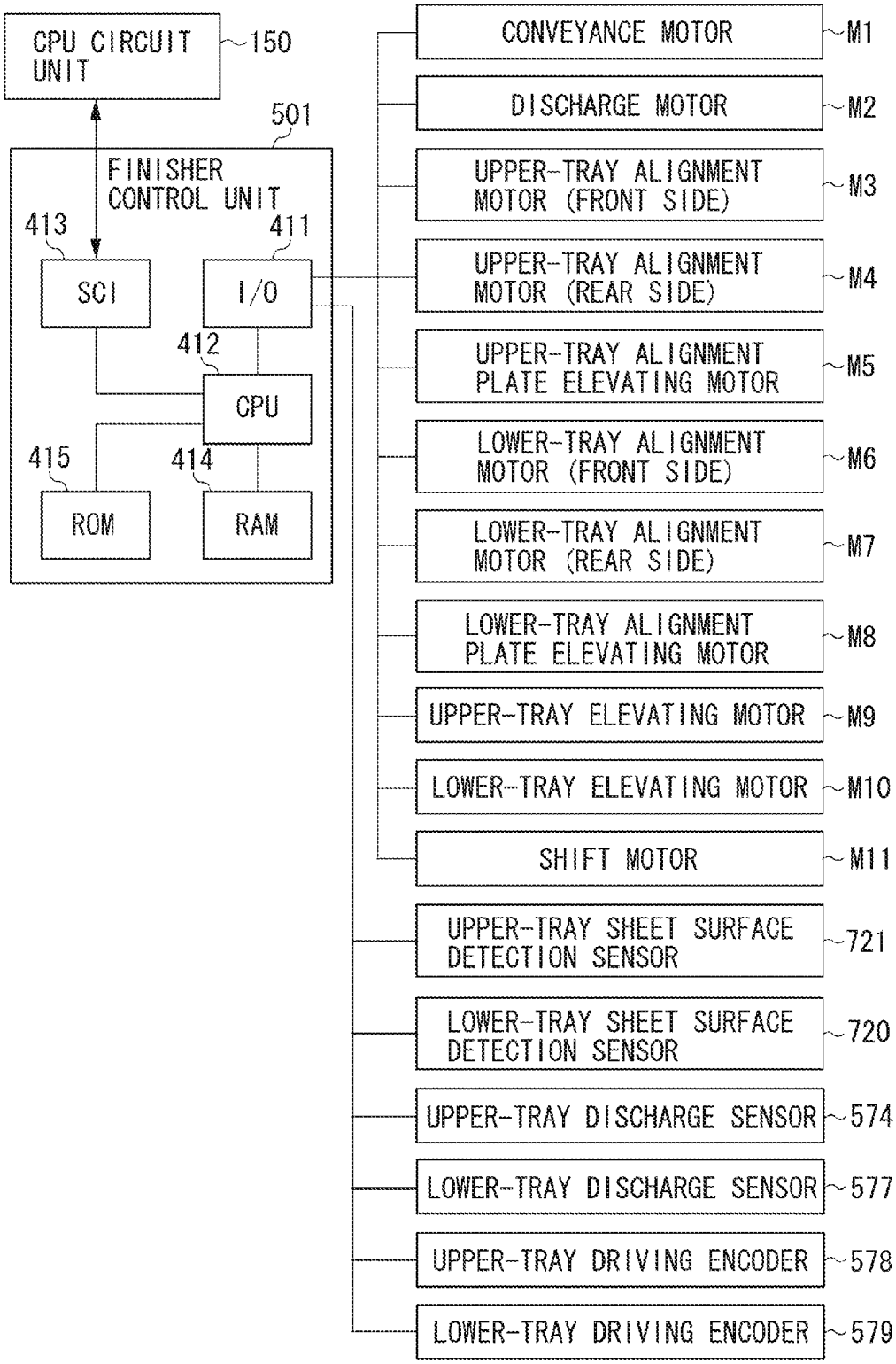
FIG. 5 is a block diagram illustrating an electrical configuration of the finisher.

Next, a configuration of the finisher control unit 501 will be described with reference to a block diagram in FIG. 5. The finisher control unit 501 includes a CPU 412, a RAM 414, a ROM 415, an input/output unit (I/O) 411, and a serial communication interface (SCI) 413, for example. The finisher control unit 501 communicates with the CPU circuit unit 150, exchanges data such as commands, job information, and sheet transfer notifications, and executes various programs stored in the ROM 415, to drive and control the finisher 500. The RAM 414 temporarily stores control data and is used as a work area for calculation processing executed for a control operation. The SCI 413 executes serial communication with the CPU circuit unit 150 of the image forming apparatus 10, to transfer operation instructions and control data. The I/O unit 411 transmits an on/off signal supplied from the CPU 412 to an output device such as a motor. In addition, the I/O unit 411 transmits a signal from an input device such as a sensor to the CPU 412. The I/O unit 411 is connected to the conveyance motor M1, the discharge motor M2, the upper-tray alignment motor (front side) M3, the upper-tray alignment motor (rear side) M4, and the upper-tray alignment plate elevating motor M5. In addition, the I/O unit 411 is connected to the lower-tray alignment motor (front side) M6, the lower-tray alignment motor (rear side) M7, the lower-tray alignment plate elevating motor M8, the upper-tray elevating motor M9, the lower-tray elevating motor M10, and the shift motor M11. In addition, the I/O unit 411 is connected to the upper-tray sheet surface detection sensor 721, the lower-tray sheet surface detection sensor 720, the upper-tray discharge sensor 574, and the lower-tray discharge sensor 577.

In addition, the I/O unit 411 is connected to upper- and lower-tray driving encoders 578 and 579, respectively. Each of the upper- and lower-tray driving encoders 578 and 579 outputs a pulse signal depending on the movement of the stacking trays 701 and 700, respectively, which is lifted or lowered based on the detection of the top surface of the sheets on the stacking trays 701 and 700. By counting the pulse signals output from the upper- and lower-tray driving encoders 578 and 579, the CPU 412 can determine the movement amounts of the stacking trays 701 and 700.

Figure 6:
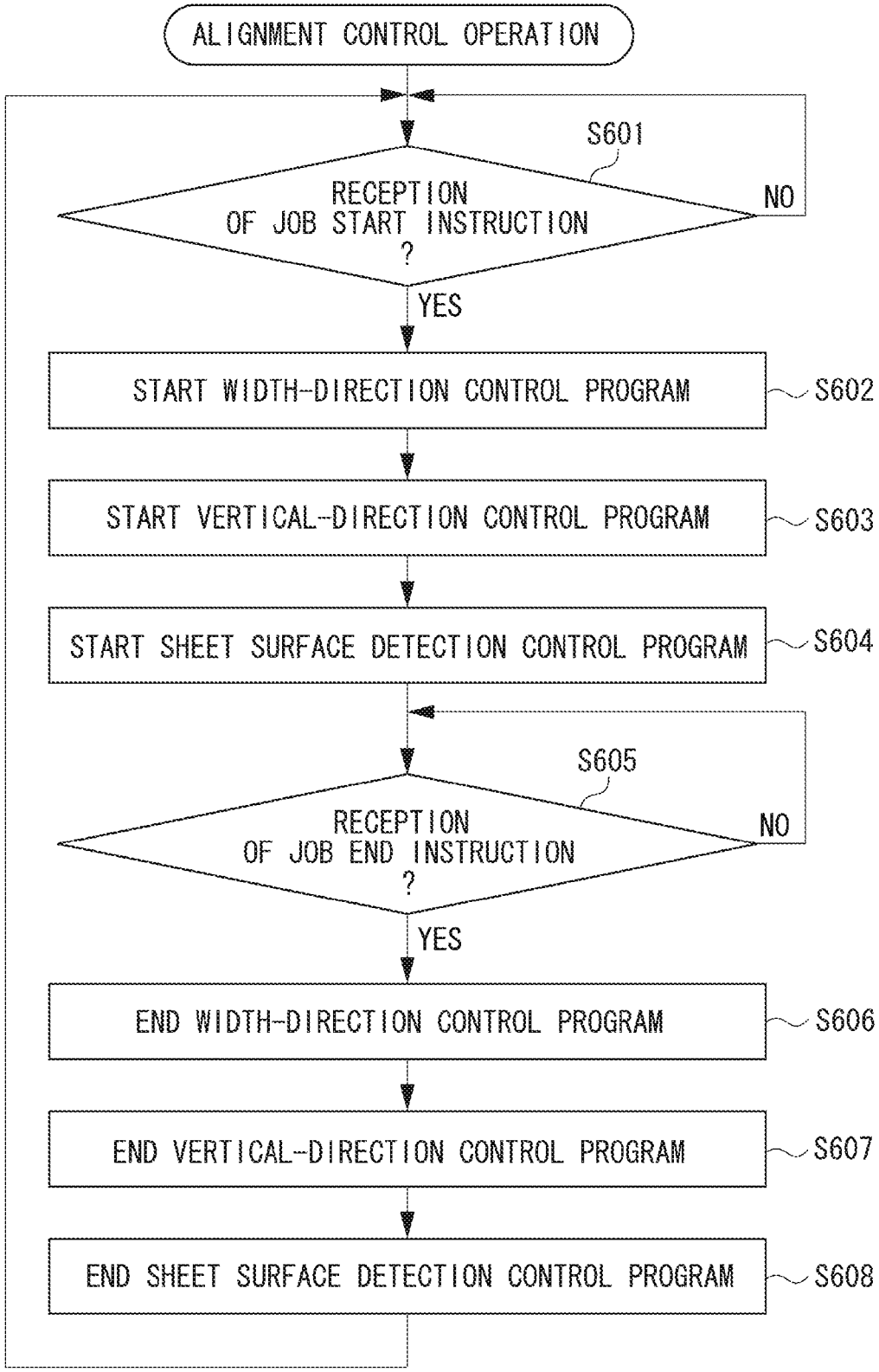
FIG. 6 is a flow chart illustrating an alignment control operation executed by the finisher.

Next, an alignment plate control operation executed by the finisher control unit 501 will be described. FIG. 6 is a flow chart illustrating an alignment control operation executed by the CPU 412.

First, in step S601, the CPU 412 determines whether the CPU 412 has received a job start instruction from the CPU circuit unit 150. Along with a job start instruction, for each sheet, sheet information including a sheet output destination and a sheet size is transmitted from the CPU circuit unit 150 to the CPU 412. If the CPU 412 determines reception of a job start instruction from the CPU circuit unit 150 (YES in step S601), the operation proceeds to step S602. In step S602, the CPU 412 sets a flag in the RAM 414, to start a program for controlling the alignment plates of a discharge destination stacking tray in the width direction. This width-direction control program will be described below.

Next, in step S603, the CPU 412 sets a flag in the RAM 414, to start a program for controlling the alignment plates of the discharge destination stacking tray in the vertical direction. This vertical-direction control program will be described below.

Next, in step S604, the CPU 412 sets a flag, to start a program for controlling detection of the sheet surface on the discharge destination stacking tray. This sheet surface detection control program will be described below. If the above flags are set, the CPU 412 repeatedly executes the width- and vertical-direction control programs and the sheet surface detection control program in a time-division manner. Next, in step S605, the CPU 412 determines whether the CPU 412 has received a job end instruction from the CPU circuit unit 150. If the CPU 412 determines reception of a job end instruction (YES in step S605), the operation proceeds to steps S606 to S608 in which the CPU 412 resets the above flags. Thus, the width- and vertical-direction control programs and the sheet surface detection control program are ended.

Figure 7:
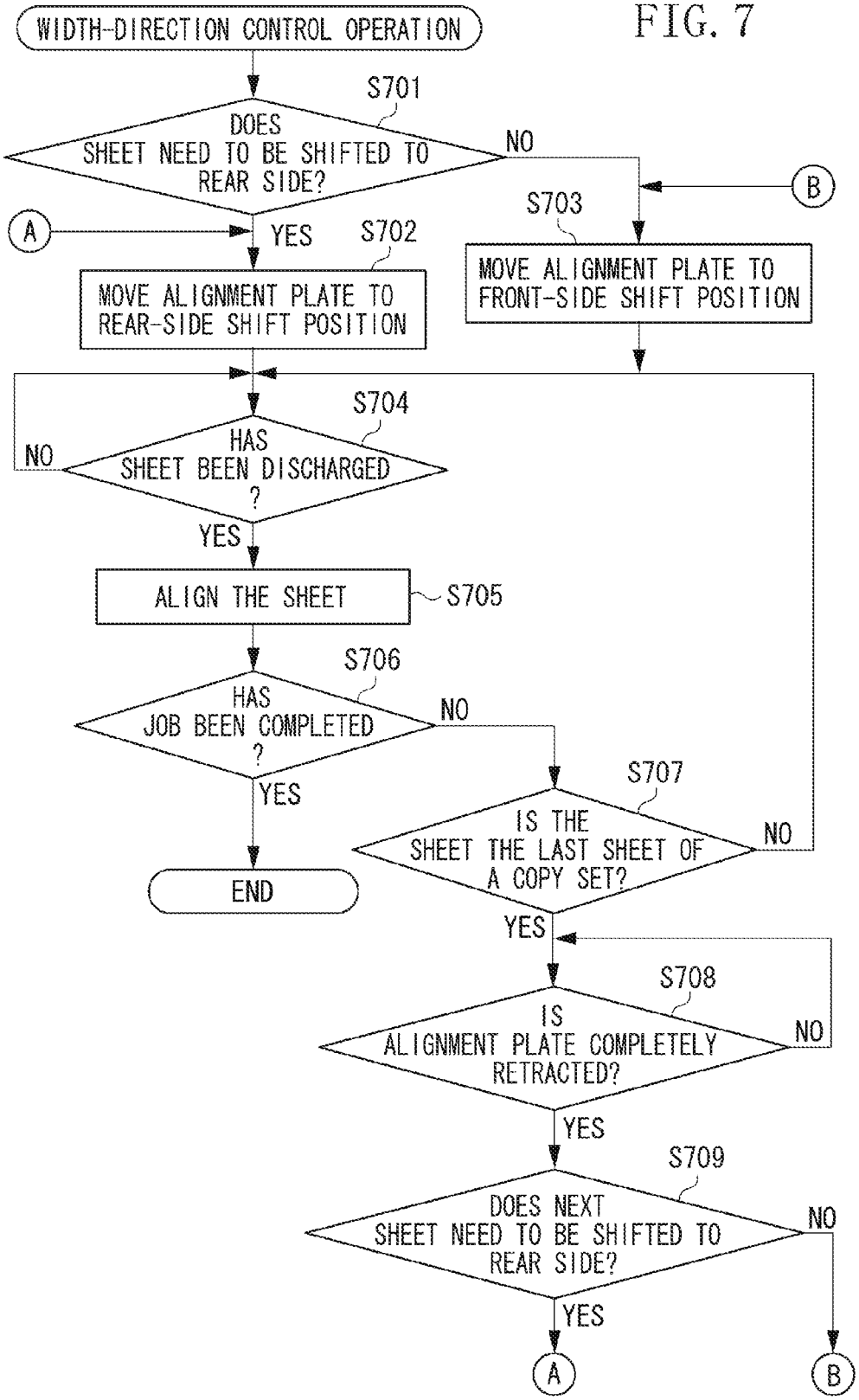
FIG. 7 is a flow chart illustrating an operation of controlling movement of alignment members in a width direction.

Next, the width-direction control program will be described with reference to FIG. 7. Since the alignment plate 711 is controlled in the same way as the alignment plate 710, only an operation of controlling the alignment plate 711 will be described. FIG. 7 is a flow chart illustrating an operation of controlling movement of the alignment plate 711 in the width direction, which is executed by the CPU 412 in a time-division manner.

First, in step S701, based on the sheet information about a sheet N (N is a natural number) transmitted from the CPU circuit unit 150, the CPU 412 determines whether the sheet N needs to be shifted to the rear side. Assuming that FIG. 2A illustrates the front side of the finisher 500, this rear side corresponds to the depth direction of the finisher 500. In other words, this rear side corresponds to the left side of the finisher 500 in FIG. 2B. In addition to the shift direction, the sheet information includes information about the sheet size, material, surface property, and grammage. Before the finisher 500 receives a sheet from the image forming apparatus 10, the CPU 412 is notified of the sheet information.

In step S701, if the CPU 412 determines that the sheet needs to be shifted to the rear side (YES in step S701), the operation proceeds to step S702. If not (NO in step S701), the operation proceeds to step S703. In step S702, by driving the upper-tray alignment motors M3 and M4, the CPU 412 moves the alignment plate 711 to a rear-side shift position. In step S703, by driving the upper-tray alignment motors M3 and M4, the CPU 412 moves the upper-tray alignment plate 711 to a front-side shift position. Namely, the upper-tray alignment motors M3 and M4 function as a third moving unit. After the CPU 412 moves the alignment plate 711 in step S702 or S703, the operation proceeds to step S704.

In step S704, the CPU 412 determines whether a sheet has been discharged onto the stacking tray 701. More specifically, if a predetermined time period elapses after the upper-tray discharge sensor 574 detects passage of the trailing edge of the sheet N, the CPU 412 determines that the sheet N has been discharged. If the CPU 412 determines discharge of the sheet N (YES in step S704), the operation proceeds to step S705.

In step S705, the CPU 412 moves the alignment plate 711 in the width direction to align the sheet N. This alignment control operation will be described in detail below.

Next, in step S706, the CPU 412 determines whether the job has been completed. The CPU 412 determines that the job has been completed, if the flag is reset in step S606 in FIG. 6. If the CPU 412 determines that the flag has been reset (YES in step in S706), the CPU 412 ends the operation. If not (NO in step in S706), the operation proceeds to step S707.

In step S707, the CPU 412 determines whether the discharged sheet N is the last sheet of a copy set. More specifically, the CPU 412 determines whether the discharged sheet N is the last sheet of a copy set of a plurality of copy sets or the last sheet of a copy set of a single print job. Namely, after the last sheet of a copy set, the sheet stacking position on the tray is changed. For example, if the sheet N is set to be stacked on the rear side and the next sheet N+1 is set to be stacked on the front side, the sheet stacking position is changed between the sheet N and the sheet N+1. Thus, the CPU 412 determines that the sheet N is the last sheet of a copy set. There are cases where booklets as print products are alternately stacked on the front and rear sides on a stacking tray and where booklets are alternately stacked every ten booklets. The CPU circuit unit 150 notifies the CPU 412 of the timing of switching the stacking position.

In step S707, if the CPU 412 does not determine that the discharged sheet N is the last sheet of a copy set (NO in step S707), the operation returns to step S704, and the CPU 412 waits for a sheet to be discharged. In step S707, if the CPU 412 determines that the discharged sheet N is the last sheet of a copy set (YES in step S707), the operation proceeds to step S708.

Figure 10:
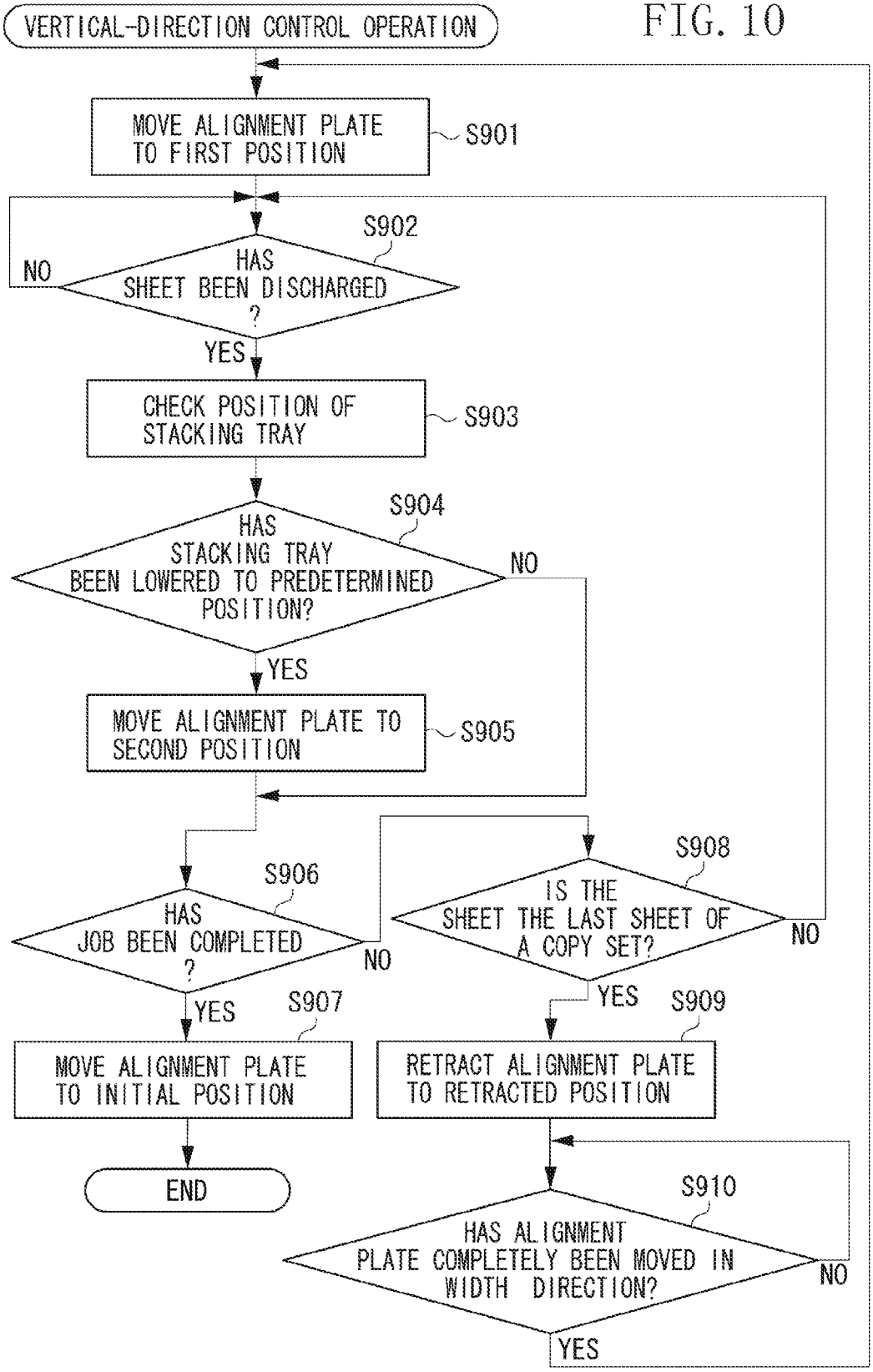
FIG. 10 is a flow chart illustrating an operation of controlling movement of the alignment members in a vertical direction.

In step S708, to move the alignment plate 711 in the width direction, the CPU 412 waits until the alignment plate 711 is completely retracted by a vertical direction control operation in FIG. 10. More specifically, the CPU 412 waits until the alignment plate 711 is completely moved to a retracted position in step S909 in FIG. 10. If the alignment plate 711 is completely retracted (YES in step S708), the operation proceeds to step S709.

In step S709, the CPU 412 determines whether the next sheet needs to be shifted to the rear side. If so (YES in step S709), the operation returns to step S702. If not (NO in step S709), the operation returns to step S703.

Next, the operation of controlling the alignment plate 711 in the width direction will be described in detail with reference to FIGS. 8A, 8B, 8C, 8D, 8E, and 8F and FIGS. 9A, 9B, 9C, 9D, 9E, and 9F.

Figure 8A:
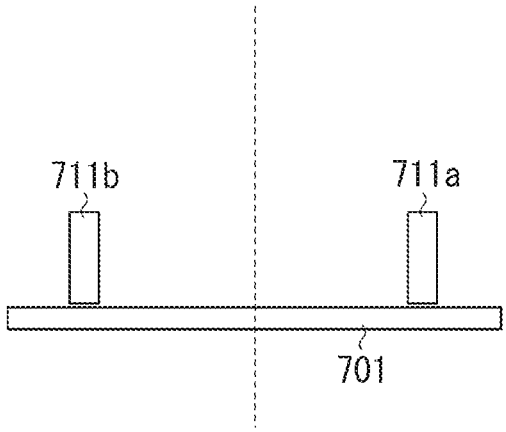
FIGS. 8A, 8B, 8C, 8D, 8E, and 8F illustrate movement of the alignment members in the width direction.
Figure 8B:
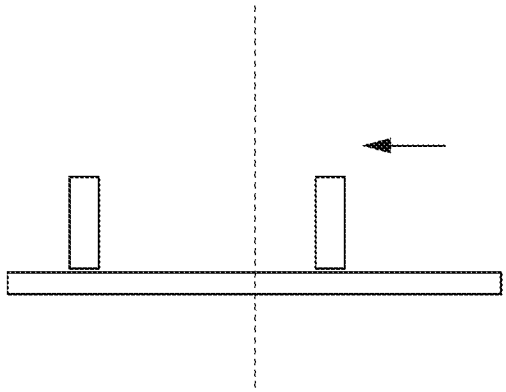
Figure 8C:
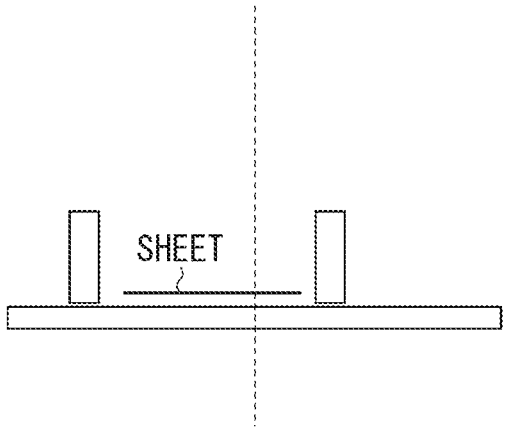
Figure 8D:
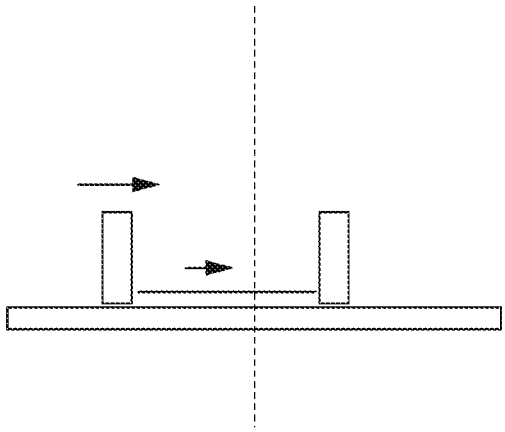
Figure 8E:
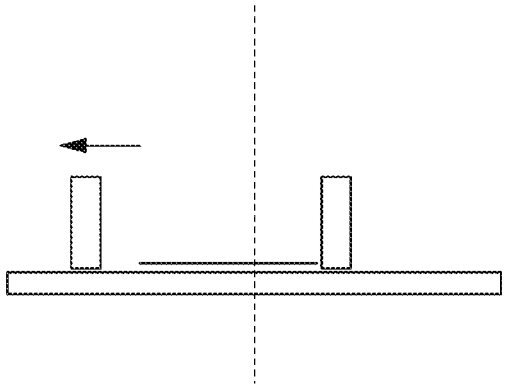
Figure 8F:
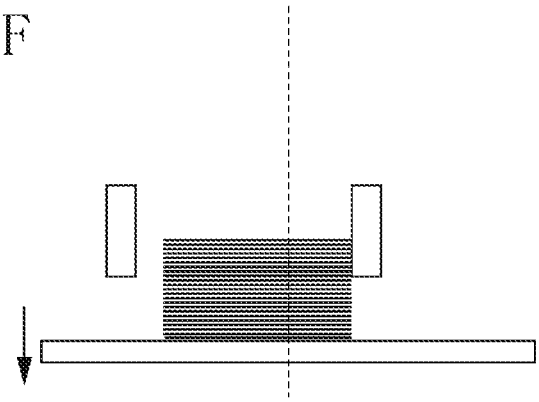

FIG. 8A illustrates an initial state of the stacking tray 701 and the alignment plate 711. A job is started in this state. The dashed line in FIGS. 8A to 8E indicates the center position of the stacking tray 701 in the width direction. This operation will be described, assuming that, at the start of the job, the CPU circuit unit 150 notifies the CPU 412 that the sheet needs to be shifted to the rear side. In this case, the operation proceeds from step S701 to step S702 in the flowchart in FIG. 7, and the alignment plates 711*a* and 711*b* are positioned as illustrated in FIG. 8B. Namely, while the alignment plate 711*b* is not moved, the alignment plate 711*a* is moved toward the center position. Next, as illustrated in FIG. 8C, a sheet is discharged onto the stacking tray 701. Next, as illustrated in FIG. 8D, the alignment plate 711*b* is moved by the upper-tray alignment motor M4 in the direction indicated by the arrows in FIG. 8D. Accordingly, the alignment plate 711*a* comes into contact with the sheet, and the sheet is then aligned. Next, as illustrated in FIG. 8E, the alignment plate 711*b* is moved in the direction of the arrow in FIG. 8E. This state is maintained until the next sheet is discharged. Each time a sheet is stacked on the tray 701, the alignment plate 711*b* is repeatedly moved as illustrated in FIGS. 8D and 8E. As a result, the sheets are stacked as illustrated in FIG. 8F. As the number of the sheets stacked on the stacking tray 701 is increased, the stacking tray 701 is lowered, and the position of the top sheet surface is maintained at a certain height.

Figure 9A:
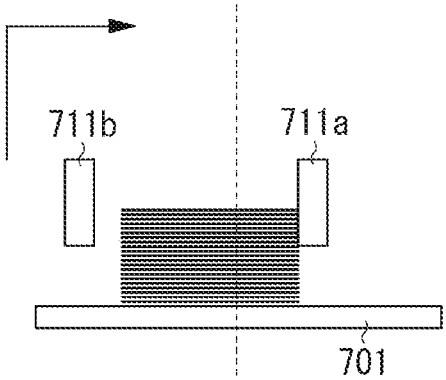
FIGS. 9A, 9B, 9C, 9D, 9E, and 9F illustrate movement of the alignment members in the width direction.
Figure 9B:
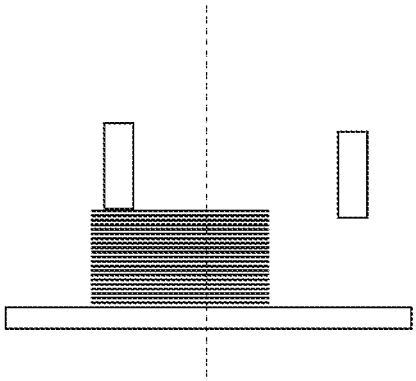
Figure 9C:
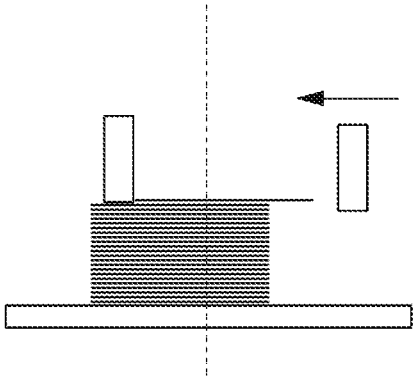
Figure 9D:
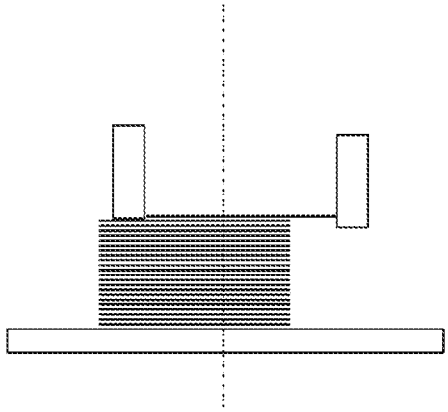
Figure 9E:
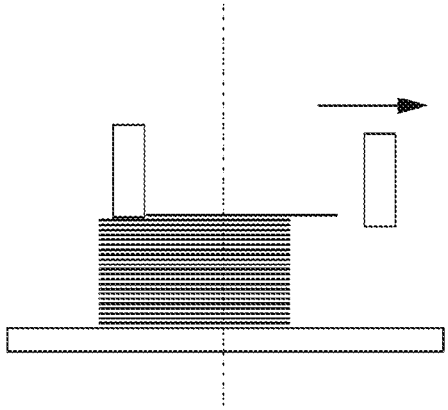
Figure 9F:
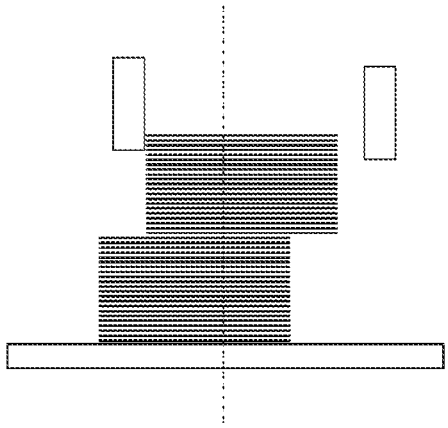

Next, as illustrated by the arrow in FIG. 9A, the alignment plate 711 is first lifted above the sheet stack and is next moved to the front side (to the right side in FIG. 9A) to change the alignment position. Next, the alignment plate 711 is lowered to an alignment standby position as illustrated in FIG. 9B. In this state, if a sheet is discharged onto the stacking tray 701, the alignment plate 711*a* is moved toward the center position, as illustrated in FIG. 9C. Accordingly, the alignment plate 711*b* comes into contact with the sheet, and the sheet is then aligned, as illustrated in FIG. 9D. Next, as illustrated in FIG. 9E, the alignment plate 711*a* returns to the alignment standby position and waits until the next sheet is stacked. Each time a sheet is stacked on the tray 701, the alignment plate 711*a* is repeatedly moved as illustrated in FIGS. 9C to 9E. As a result, the sheets are stacked as illustrated in FIG. 9F.

Next, the operation of controlling the alignment plate 711 in the vertical direction will be described. Since the alignment plate 711 is controlled in the same way as the alignment plate 710, only the operation of controlling the alignment plate 711 will be described.

Figure 12A:
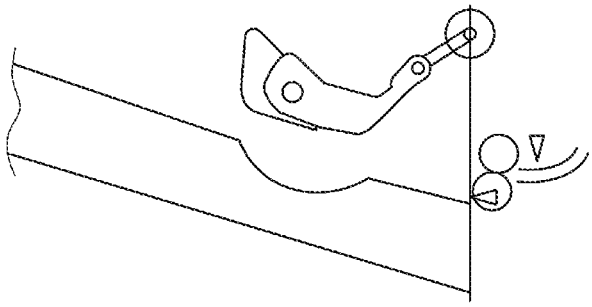
FIGS. 12A, 12B, 12C, 12D, 12E, 12F, and 12G illustrate movement of an alignment member in the vertical direction.

FIG. 10 is a flow chart illustrating an operation of controlling movement of the alignment plate 711 in the vertical direction, executed by the CPU 412 in a time-division manner. Prior to this control operation, the alignment plate 711 is maintained at an initial position as illustrated in FIG. 12A. At this initial position, the alignment plate 711 is positioned above the stacking tray 701.

Figure 12B:
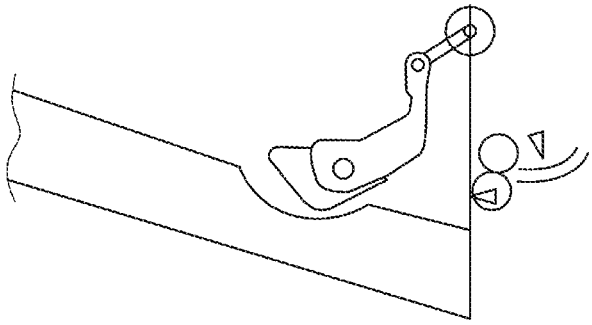

First, in step S901, the CPU 412 drives the upper-tray alignment plate elevating motor M5 to move the alignment plate 711 to a first position as illustrated in FIG. 12B.

Figure 12C:
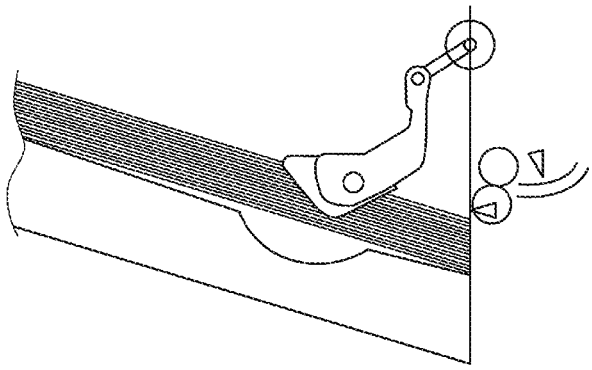
Figure 12D:
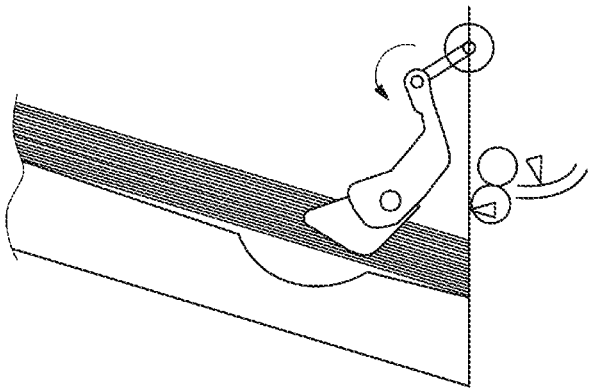

Next, in step S902, the CPU 412 waits for a sheet to be discharged. If the CPU 412 determines that a sheet has been discharged onto the stacking tray 701 (YES in step S902), the operation proceeds to step S903. In step S903, the CPU 412 checks the position of the stacking tray 701. A procedure for checking the position of the stacking tray 701 will be described in detail below. As illustrated in FIG. 12C, the stacking tray 701 is lowered, as the number of the stacked sheets is increased. Next, in step S904, the CPU 412 determines whether the stacking tray 701 has been lowered to a predetermined position. If so (YES in step S904), the operation proceeds to step S905. In step S905, the CPU 412 drives the upper-tray alignment plate elevating motor M5 to move the alignment plate 711 to a second position. Namely, the upper-tray alignment plate elevating motor M5 functions as a second moving unit. More specifically, in step S904, the CPU 412 determines whether the stacking tray 701 is approximately 10 mm below an adjusted position. This adjusted position is set when a sheet surface detection control operation is executed on the upper discharge tray 701 having no sheet. In addition, as illustrated in FIG. 12D, the alignment plate 711 at the second position is lower in the moving direction of the stacking tray 701 than that at the first position illustrated in FIGS. 12B and 12C.

Next, in step S906, the CPU 412 determines whether the job has been completed. If so (YES in step S906), the operation proceeds to step S907. If not (NO in step S906), the operation proceeds to step S908.

Figure 12E:
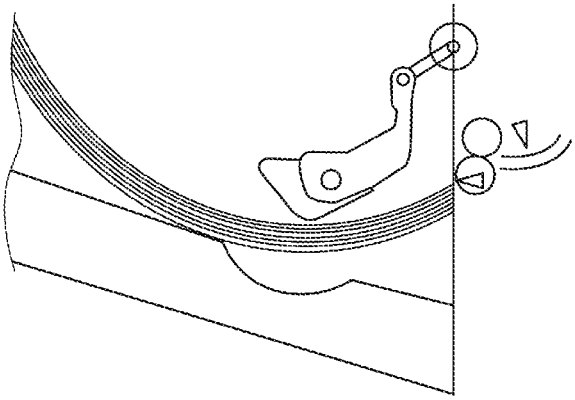
Figure 12F:
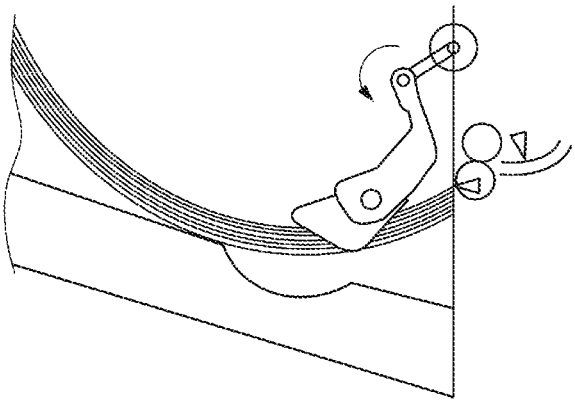
Figure 12G:
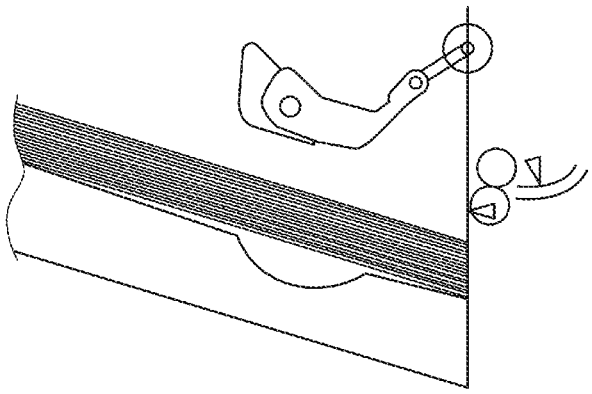

In step S907, the CPU 412 drives the upper-tray alignment plate elevating motor M5 to move the alignment plate 711 to the initial position as illustrated in FIG. 12G.

In step S908, the CPU 412 determines whether the discharged sheet is the last sheet of a copy set. If so (YES in step S908), the operation proceeds to step S909. If not (NO in step S908), the operation returns to step S902 and waits for the next sheet to be discharged.

In step S909, to change the sheet alignment direction, the CPU 412 retracts the alignment plate 711 to the retracted position where the alignment plate 711 does not come into contact with the stacked sheets. The retracted position is the same as the above initial position. Namely, the alignment plate 711 is retracted as illustrated in FIG. 12G.

Next, in step S910, the CPU 412 determines whether the alignment plate 711 has completely been moved in the width direction. More specifically, the CPU 412 determines whether movement of the alignment plate 711 in step S702 or S703 in the flow chart in FIG. 7 has been completed. If the movement of the alignment plate 711 in the width direction is completed (YES in step S910), the operation returns to step S901.

As described above, when the alignment plate control operation in the vertical direction is started, the CPU 412 moves the alignment plate 711 to the first position. When the position of the discharge tray 701 is lowered by a predetermined amount by the stacked sheets, the CPU 412 moves the alignment plate 711 to the second position. Thus, even if curled sheets are stacked, the alignment plate 711 does not execute a missed swing. For example, as illustrated in FIG. 12E, if the alignment plate 711 attempts to align the sheets at the first position, the alignment plate 711 does not come into contact with the sides of the sheets, possibly resulting in a missed swing. However, as illustrated in FIG. 12F, as the stacking tray 701 is lowered to the predetermined position, since the alignment plate 711 is moved to the second position, the alignment plate 711 comes into contact with the sides of the sheets. Thus, the alignment plate 711 does not execute a missed swing. When stacked sheets are not curled, even if the alignment plate 711 is moved to the second position, the alignment plate 711 simply comes into contact with the sides of the sheets at a different position. Thus, the alignment operation is not affected.

In the above description, after the last sheet of a copy set is stacked on the stacking tray 701 and the CPU 412 moves the alignment plate 711 to the retracted position, the CPU 412 first moves the alignment plate 711 to the first position, instead of immediately moving the alignment plate 711 to the second position. The reason for this operation will be hereinafter described.

Figure 13A:
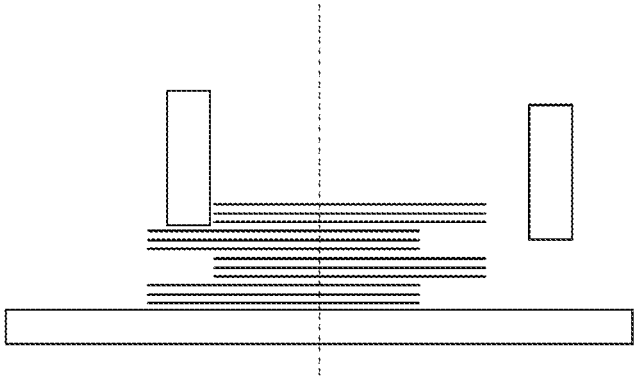
FIGS. 13A and 13B illustrate states of the alignment members and sheet stacks when the alignment position is changed.
Figure 13B:
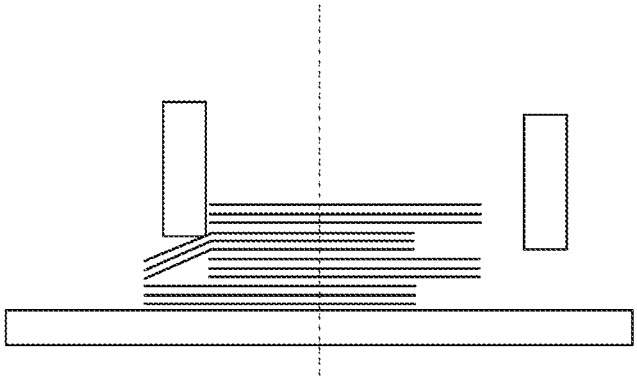
Figure 14A:
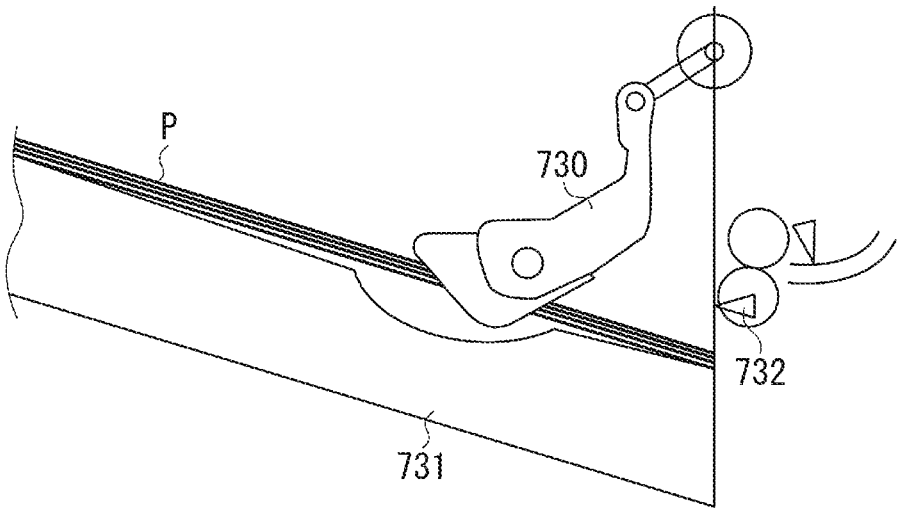
FIGS. 14A and 14B illustrate a problem with a conventional technique.
Figure 14B:
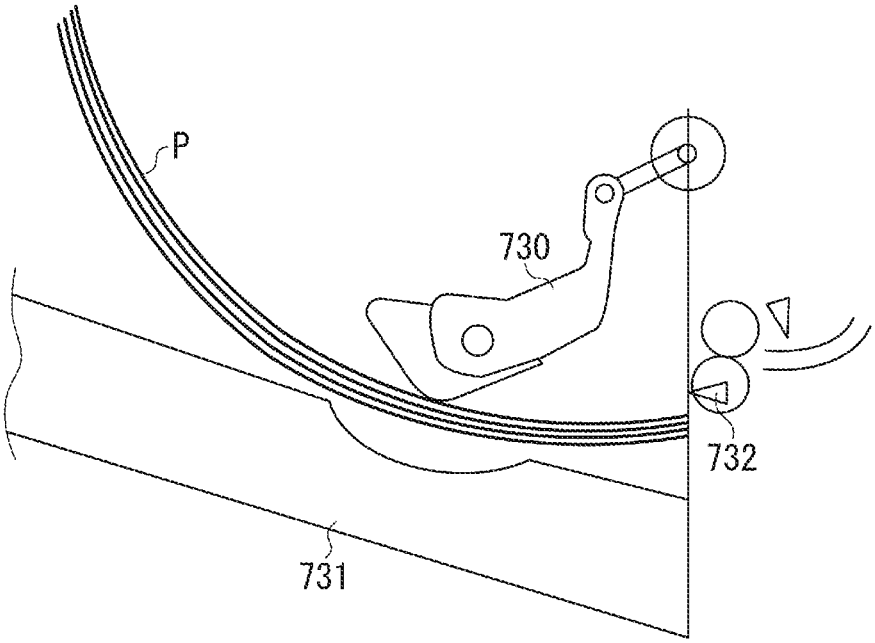

FIGS. 13A and 13B illustrate the alignment plate 711 at the first and second positions, respectively. As illustrated in FIGS. 13A and 13B, when sheet stacks shifted to the front side and sheet stacks shifted to the rear side are stacked on each other, if the shift direction is changed and the alignment plate 711 is moved to the second position, the alignment plate 711 may press and damage a stacked sheet stack. Thus, in the present exemplary embodiment, if the shift direction is changed and if the position of the alignment plate 711 is changed in the width direction, the alignment plate 711 is returned to the first position. A one-way clutch may be arranged at the elevating shaft 712 of the alignment plate 711 (711*a* and 711*b*). In this way, when the alignment plate 711 rotates in the direction in which the sheets are pressed, the sheets are not pressed more than necessary. If such configuration is used, the operation may proceed from S910 to S905 in the flow chart in FIG. 10.

Next, an operation of controlling detection of the sheet surface on the stacking tray will be described. Since the operation of controlling detection of the sheet surface on the stacking tray 701 is the same as that on the stacking tray 700, only the operation of controlling detection of the sheet surface on the stacking tray 701 will be described.

Figure 11:
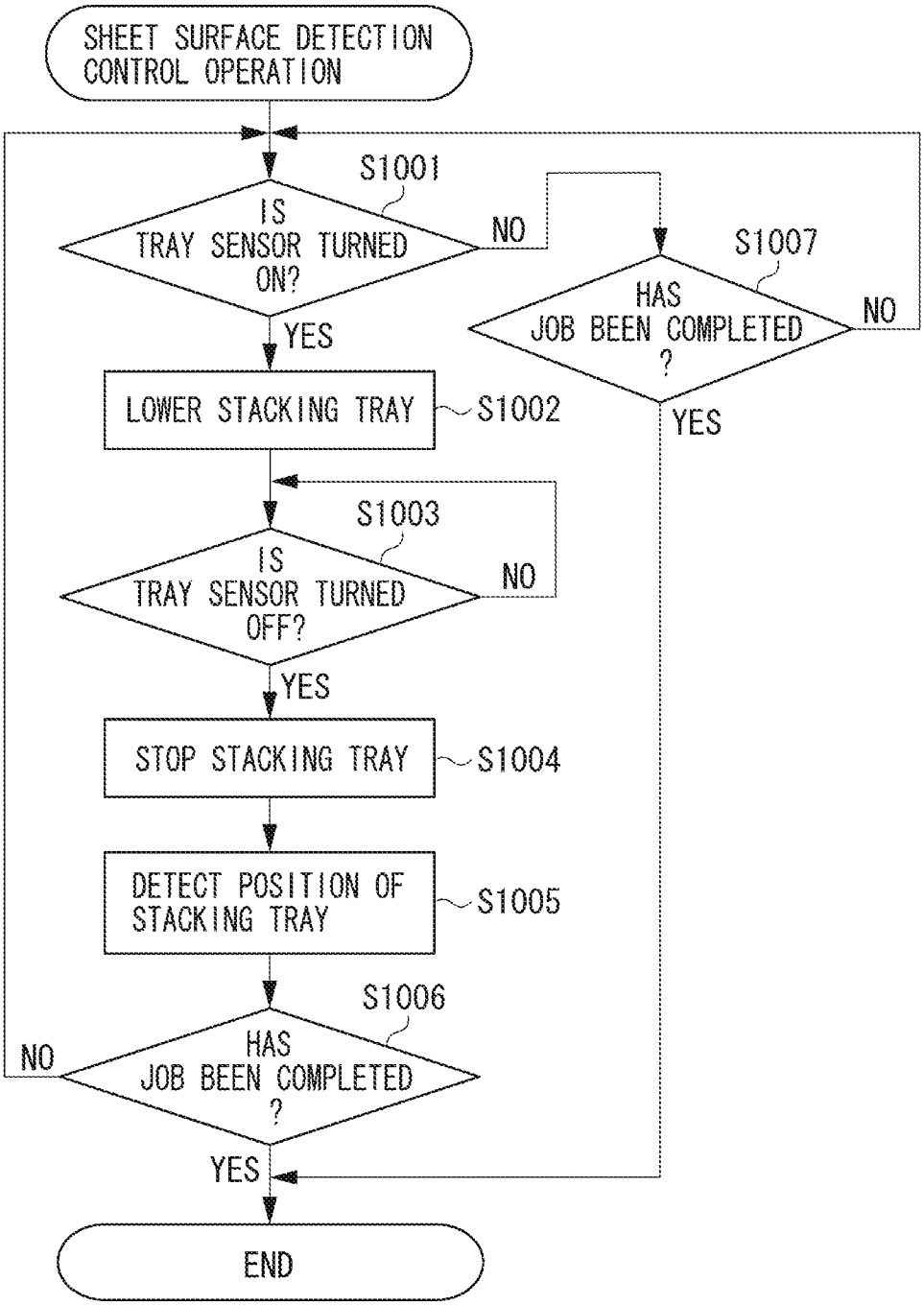
FIG. 11 is a flow chart illustrating an operation of controlling detection of a sheet surface on a stacking tray.

FIG. 11 is a flow chart illustrating an operation of controlling detection of the sheet surface on the stacking tray 701, which is executed by the CPU 412 in a time-division manner.

First, in step S1001, the CPU 412 determines whether the upper-tray sheet surface detection sensor 721 is turned on. The sheet surface detection sensor 721 turns on when sheets are stacked on the stacking tray 701 up to a position near the discharge roller 515. If the sheet surface detection sensor 721 is not turned on (NO in step S1001), the operation proceeds to step S1007. In step S1007, the CPU 412 determines whether the job has been completed. If not (NO in step S1007), the operation returns to step S1001. If so (YES in step S1007), the CPU 412 ends the operation.

If the CPU 412 determines that the sheet surface detection sensor 721 is turned on (YES in step S1001), the operation proceeds to step S1002. In step S1002, the CPU 412 drives the upper-tray elevating motor M9 to start lowering the stacking tray 701. Namely, the upper-tray elevating motor M9 functions as a first moving unit. When the CPU 412 drives the upper-tray elevating motor M9, the encoder 578 attached to the rotation shaft of the motor M9 outputs a pulse signal. The pulse signal is supplied to the CPU 412 via the I/O unit 411. The CPU 412 counts the pulse signals to detect the movement amount of the stacking tray 701.

Next, in step S1003, the CPU 412 waits until the sheet surface detection sensor 721 is turned off. The sheet surface detection sensor 721 is arranged below the sheet discharge port. If the CPU 412 detects that the sheet surface detection sensor 721 is turned off (YES in step S1003), the operation proceeds to step S1004. In step S1004, the CPU 412 stops the upper-tray elevating motor M9. Next, in step S1005, the CPU 412 detects the position of the stacking tray 701, based on the counted pulses.

Next, in step S1006, the CPU 412 determines whether the job has been completed. If the flag is reset in step S608 in the flow chart in FIG. 6, the CPU 412 determines that the job has been completed. If the job is completed (YES in step S1006), the CPU 412 ends the operation. If not (NO in step S1006), the operation returns to step S1001.

In the present exemplary embodiment, the CPU 412 counts the pulse signals from the encoder 578 to detect the position of the stacking tray 701. However, the CPU 412 may count the stacked sheets to detect the position of the stacking tray 701.

As described above, in the present exemplary embodiment, when sheets are stacked on a stacking tray, the position of the alignment plates is controlled in the vertical direction depending on the position of the stacking tray. More specifically, when stacking is started, the CPU 412 moves the alignment plates to the first position, where the alignment plates do not come into contact with the stacking tray, and causes the alignment plates to align the sheets. Subsequently, when sheets are stacked and the stacking tray is lowered, the CPU 412 moves the alignment plates to the second position and causes the alignment plates to align the sheets. In this way, curled sheets can be aligned, without requiring a dedicated sensor for detecting a sheet surface position at a position where the alignment plates come into contact with the sheets.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-171996 filed Aug. 5, 2011, which is hereby incorporated by reference herein in its entirety.

What is claimed is:

1. A sheet stacking apparatus, comprising:

a discharging unit configured to discharge a conveyed sheet;

a stacking tray on which a sheet discharged by the discharging unit is stacked;

an alignment unit configured to align a sheet stacked on the stacking tray in a width direction perpendicular to a direction in which the sheet is discharged, the alignment unit including an alignment member configured to be movable in the width direction, and a first moving unit configured to move the alignment member in the width direction, the alignment member aligning the sheet by coming into contact with a side of the sheet stacked on the stacking tray in the width direction;

a detection unit configured to detect a position of a top surface of a plurality of sheets stacked on the stacking tray;

a second moving unit configured to vertically move the stacking tray while a plurality of sheets are being stacked on the stacking tray, so that a predetermined distance is maintained between a position detected by the detection unit and a discharge port of the discharging unit;

a third moving unit configured to vertically move the alignment member; and a control unit configured to cause, if the second moving unit lowers the stacking tray to a predetermined position while the alignment unit is executing an alignment operation at a first position, the third moving unit to lower the alignment member to a second position lower than the first position and cause the alignment member to execute the alignment operation at the second position.

2. The sheet stacking apparatus according to claim 1, wherein the alignment member is arranged to extend toward the stacking tray from a position above the discharge port.

3. The sheet stacking apparatus according to claim 1, wherein, when the alignment unit changes a sheet alignment position in the width direction after executing the alignment operation at the second position, the control unit causes the third moving unit to move the alignment member to the first position and causes the alignment member to execute the alignment operation at the first position.

4. The sheet stacking apparatus according to claim 1, wherein the predetermined position is a position lowered by a predetermined amount from a position where a distance between a stacking surface of the stacking tray and the discharge port is the predetermined distance when no sheet is stacked on the stacking tray.

5. The sheet stacking apparatus according to claim 1, wherein the detection unit includes a sensor arranged below the discharge port.

6. An image forming apparatus, comprising:

an image forming unit configured to form an image on a sheet;

a discharging unit configured to discharge a sheet on which an image is formed by the image forming unit;

a stacking tray on which a sheet discharged by the discharging unit is stacked;

an alignment unit configured to align a sheet stacked on the stacking tray in a width direction perpendicular to a direction in which the sheet is discharged, the alignment unit including an alignment member configured to be movable in the width direction, and a first moving unit configured to move the alignment member in the width direction, the alignment member aligning the sheet by coming into contact with a side of the sheet stacked on the stacking tray in the width direction;

a detection unit configured to detect a position of a top surface of a plurality of sheets stacked on the stacking tray;

a second moving unit configured to vertically move the stacking tray while a plurality of sheets are being stacked on the stacking tray, so that a predetermined distance is maintained between a position detected by the detection unit and a discharge port of the discharging unit;

a third moving unit configured to vertically move the alignment member; and a control unit configured to cause, if the second moving unit lowers the stacking tray to a predetermined position while the alignment unit is executing an alignment operation at a first position, the third moving unit to lower the alignment member to a second position lower than the first position and cause the alignment member to execute the alignment operation at the second position.

* * * * *